US005776595A

United States Patent [19]

Kurokawa et al.

[11] Patent Number: 5,776,595

[45] Date of Patent: Jul. 7, 1998

[54] THERMAL TRANSFER SHEET

[75] Inventors: Kenji Kurokawa; Yasuo Tago; Seiji Tsuboi, all of Osaka, Japan

[73] Assignee: Fujicopian Co., Ltd., Osaka, Japan

[21] Appl. No.: 676,729

[22] Filed: Jul. 8, 1996

[30] Foreign Application Priority Data

Jul. 6, 1995 [JP] Japan ..... 6-170660

[51] Int. Cl.[6] ..... B41M 5/26

[52] U.S. Cl. ..... 428/212; 428/195; 428/323; 428/328; 428/330; 428/331; 428/484; 428/488.1; 428/488.4; 428/913; 428/914

[58] Field of Search ..... 428/195, 484, 428/488.1, 488.4, 212, 323, 328, 330, 331, 913, 914

[56] References Cited

U.S. PATENT DOCUMENTS 5,612,120 3/1997 Tago et al. ..... 428/195

*Primary Examiner*—Pamela R. Schwartz
*Attorney, Agent, or Firm*—Fish & Neave

[57] ABSTRACT

A thermal transfer sheet providing printed images less susceptible to deterioration over time of their gloss is provided comprising a foundation, and at least a release layer containing a paraffin wax as a principal component thereof, an intermediate layer containing a wax and a heat-meltable color ink layer which are stacked on the foundation in this order, the intermediate layer containing an isoparaffin wax and/or transparent inorganic particles.

6 Claims, No Drawings

THERMAL TRANSFER SHEET

BACKGROUND OF THE INVENTION

The present invention relates to a thermal transfer sheet and, more particularly, to a thermal transfer sheet suitable for the formation of printed images on a paper sheet having a low surface smoothness (hereinafter referred to as "rough paper sheet").

When a conventional thermal transfer sheet of the type comprising a heat-meltable color ink layer on a foundation is used for thermal transfer printing on a rough paper sheet, resulting printed images suffer the occurrence of voids and like problems.

To overcome such problems, there has been proposed a thermal transfer sheet comprising a heat-meltable color ink layer on a foundation with intervention of a release layer containing a wax as a principal component. With this thermal transfer sheet the thermal transferability of the color ink layer is improved by the use of such a release layer and, hence, resulting printed images no longer suffer the occurrence of voids.

With such a thermal transfer sheet having a release layer containing a wax as a principal component, however, the gloss of resulting printed images is deteriorated over time.

In view of the foregoing, it is an object of the present invention to provide a thermal transfer sheet having a release layer containing a wax as a principal component which is capable of providing printed images less susceptible to deterioration over time of their gloss.

The foregoing and other objects of the present invention will be apparent from the following detailed description.

SUMMARY OF THE INVENTION

In accordance with a first feature of the present invention, there is provided a thermal transfer sheet comprising a foundation, and at least a release layer containing a paraffin wax as a principal component, an intermediate layer containing a wax and a heat-meltable color ink layer which are stacked on the foundation in this order, the intermediate layer containing 10% to 100% by weight of an isoparaffin wax.

In accordance with a second feature of the present invention, there is provided a thermal transfer sheet comprising a foundation, and at least a release layer containing a paraffin wax as a principal component thereof, an intermediate layer containing a wax and a heat-meltable color ink layer which are stacked on the foundation in this order, the intermediate layer containing 10% to 50% by weight of a transparent inorganic pigment.

In accordance with a third feature of the present invention, there is provided a thermal transfer sheet comprising a foundation, and at least a release layer containing a paraffin wax as a principal component thereof, an intermediate layer containing a wax and a heat-meltable color ink layer which are stacked on the foundation in this order, the intermediate layer containing 10% to 90% by weight of an isoparaffin wax and 10% to 50% by weight of a transparent inorganic pigment.

DETAILED DESCRIPTION

The present invention will now be described in detail.

As a result of repeated intensive studies by the inventors of the present invention to investigate the cause of the phenomenon that the gloss of printed images is deteriorated over time, it has been discovered that a paraffin wax, which is frequently used as a principal component of a release layer of a thermal transfer sheet in terms of its low melt viscosity for providing good transferability, is responsible for such a phenomenon.

More specifically, the paraffin wax contains n-paraffin as a principal component and a rather high proportion of a low-molecular oily component. It has been discovered that when such a paraffin wax is used for a release layer, the paraffin wax forming the top layer of the resulting printed images causes its low-molecular oily component to bleed out onto the surface of the printed images thereby deteriorating the gloss of the printed images over time.

The present invention has been accomplished based on the above discovery.

According to the first aspect of the present invention, an intermediate layer containing 10% to 100% by weight of an isoparaffin wax is provided between a release layer containing a paraffin wax as a principal component and a color ink layer. With this constitution, the paraffin wax of the release layer and the isoparaffin wax of the intermediate layer are mixed upon thermal transfer process. Presumably this mixing allows the crystalline structure of the whole wax forming the top layer of the resulting printed images to become finer thereby causing the oily component of the paraffin wax to hardly migrate, so that the bleeding of the oily component onto the surface of the printed images is suppressed. This prevents the gloss of the printed images from deteriorating over time.

According to the second feature of the present invention, an intermediate layer containing 10% to 50% by weight of a transparent inorganic pigment is provided between a release layer containing a paraffin wax as a principal component and a color ink layer. With this constitution the paraffin wax of the release layer and the inorganic pigment of the intermediate layer are mixed upon thermal transfer process, and presumably this mixing allows the oily component of the paraffin wax to be adsorbed by the inorganic pigment thereby suppressing the bleeding of the oily component onto the surface of the resulting printed images. This prevents deterioration over time of the gloss of the printed images.

According to the third feature of the present invention, an intermediate layer containing 10% to 90% by weight of an isoparaffin wax and 10% to 50% by weight of a transparent inorganic pigment is provided between a release layer containing a paraffin wax as a principal component and a color ink layer. With this constitution deterioration over time of the gloss of resulting printed images is prevented by the combination of the foregoing function of the isoparaffin wax and the foregoing function of the inorganic pigment.

In the present invention the release layer contains a paraffin wax as a principal component thereof. To ensure good transferability of the thermal transfer sheet, the content of the paraffin wax in the release layer is preferably not less than 10% by weight, more preferably not less than 70% by weight.

The paraffin wax preferably contains not less than 10% by weight, more preferably not less than 50% by weight of n-paraffin so as to ensure satisfactory transferability of the thermal transfer sheet.

The release layer may contain other heat-meltable materials in addition to the paraffin wax. Such heat-meltable materials include other waxes and/or thermoplastic resins.

Examples of such other waxes include natural waxes such as haze wax, bees wax, lanolin, carnauba wax, candelilla wax, montan wax and ceresine wax; synthetic waxes such as oxidized waxes, ester waxes, low-molecular-weight polyethylene waxes, Fischer-Tropsch wax and α-olefin-maleic anhydride copolymer wax; higher fatty acids such as lauric acid, myristic acid, palmitic acid, stearic acid and behenic acid; higher aliphatic alcohols such as stearyl alcohol and docosanol; esters such as higher fatty acid monoglycerides, sucrose fatty acid esters and sorbitan fatty acid esters; and amides and bisamides such as oleic acid amide. These waxes may be used either alone or in combination.

Examples of such thermoplastic resins (inclusive of elastomers) include olefinic copolymers such as ethylene-vinyl acetate copolymer and ethylene-acrylate copolymer, polyamide resins, polyester resins, epoxy resins, polyurethane resins, acrylic resins, vinyl chloride resins, cellulose resins, vinyl alcohol resins, petroleum resins, phenol resins, styrene resins, vinyl acetate resins, natural rubber, styrene-butadiene rubber, isoprene rubber, chloroprene rubber, polyisobutylene and polybutene. These may be used either alone or in combination.

The coating amount (on a dry amount basis, hereinafter the same) of the release layer is preferably about 0.3 to about 1.5 g/m$^2$ in terms of heat-releasability of the release layer. The release layer may be formed by hot-melt coating, solvent coating or a like process.

The intermediate layer provided on the release layer according to the first feature of the present invention contains a wax. Specifically, the intermediate layer contains an isoparaffin wax in an amount of not less than 10% by weight, particularly not less than 30% by weight. If the amount of the isoparaffin wax is less than the range thus specified, deterioration over time of the gloss of resulting printed images cannot be satisfactorily prevented.

Preferably the isoparaffin wax contains not less than 10% by weight, particularly not less than 30% by weight of isoparaffin from the viewpoint of preventing deterioration over time of the gloss of resulting printed images. It is possible to use a microcrystalline wax or a like wax as the isoparaffin wax as long as the amount of isoparaffin contained therein is within the range specified above.

The intermediate layer may contain other waxes in addition to the isoparaffin wax. Any of the foregoing waxes listed for use in the release layer can be used in the intermediate layer.

The intermediate layer may further contain a small amount of a thermoplastic resin. Examples of such thermoplastic resins are those previously listed for use in the release layer.

The coating amount of the intermediate layer is preferably 0.3 to 3.0 g/m$^2$, more preferably 0.8 to 2.0 g/m$^2$. If the coating amount is less than that range, deterioration of the gloss of resulting printed images is likely to be insufficiently prevented. On the other hand, if the coating amount exceeds the range, the transfer sensitivity of the thermal transfer sheet tends to decrease.

In the thermal transfer sheet according to the second feature of the present invention the intermediate layer provided on the release layer contains, in addition to a wax, 10% to 50% by weight, particularly 10% to 40% by weight of transparent inorganic particles. If the content of the transparent inorganic pigment is less than that range, the oily component of the paraffin wax will not be sufficiently adsorbed by the inorganic particles, resulting in printed images having a gloss unsuccessfully prevented from deteriorating. On the other hand, if the content of transparent inorganic particles is greater than the above range, the adhesion between the intermediate layer and the release layer or the color ink layer tends to become poor, which may result in frequent occurrences of "ink falling" (which means a phenomenon that an ink layer exfoliates when, for example, the ink ribbon is traveling).

The term "transparent inorganic particles" herein means transparent inorganic particles which provide a substantially transparent ink when dispersed in a transparent vehicle.

Examples of specific transparent inorganic particles include silica powder, titanium oxide and calcium carbonate. These particles may be used either alone or as mixtures.

The wax component of the intermediate layer is not particularly limited and may comprise any of those previously listed for use in the release layer.

The intermediate layer may further contain a thermoplastic resin which may comprise any of those previously listed for use in the release layer.

The coating amount of the intermediate layer is preferably 0.3 to 3.0 g/m$^2$, more preferably 0.8 to 2.0 g/m$^2$. If the coating amount is less than that range, deterioration of the gloss of resulting printed images is likely to be insufficiently prevented. On the other hand, if the coating amount exceeds the range, the transfer sensitivity of the thermal transfer sheet tends to decrease.

In the thermal transfer sheet according to the third feature of the present invention the intermediate layer provided on the release layer contains a wax. Specifically, the intermediate layer contains 10% to 90% by weight, particularly 10% to 80% by weight of an isoparaffin wax and 10% to 50% by weight, particularly 10% to 40% by weight of transparent inorganic particles. If the content of the isoparaffin wax is less than that range, the gloss of resulting printed images is not sufficiently prevented from deteriorating. On the other hand, if the content of the isoparaffin wax is greater than the range, a larger printing energy is required and there is a tendency to provide unclear printed images. If the content of transparent inorganic particles is less than the range as specified above, the oily component of the paraffin wax will not be sufficiently adsorbed by the inorganic pigment, resulting in printed images having a gloss unsuccessfully prevented from deteriorating. On the other hand, if the content of the transparent inorganic pigment is greater than the above range, the adhesion between the intermediate layer and the release layer or the color ink layer tends to become poor, which may result in frequent occurrences of the ink falling.

Examples of specific isoparaffin waxes include those previously described for the first feature of the present invention. Examples of specific inorganic pigments include those previously described for the second feature of the present invention.

The wax component other than the isoparaffin wax may comprise any of those listed for use in the release layer.

The intermediate layer may further contain a thermoplastic resin, examples of which include those listed for use in the release layer.

The coating amount of the intermediate layer is preferably 0.3 to 3.0 g/m$^2$, more preferably 0.8 to 2.0 g/m$^2$. If the coating amount is less than that range, deterioration of the gloss of resulting printed images is likely to be insufficiently prevented. On the other hand, if the coating amount exceeds the range, the transfer sensitivity of the thermal transfer sheet tends to decrease.

The intermediate layer in each of the first, second and third features of the present invention can be formed by hot-melt coating, solvent coating or a like process.

The heat-meltable color ink layer according to the present invention comprises a coloring agent and a heat-meltable vehicle. Any conventional heat-meltable color ink can be used for the heat-meltable color ink layer without particular limitation. The heat-meltable vehicle may comprise a wax and/or a thermoplastic resin.

Examples of such waxes include natural waxes such as haze wax, bees wax, lanolin, carnauba wax, candelilla wax, montan wax and ceresine wax; petroleum waxes such as n-paraffin wax, isoparaffin wax, paraffin wax and microcrystalline wax; synthetic waxes such as oxidized waxes, ester waxes, low-molecular-weight polyethylene waxes, Fischer-Tropsch wax and α-olefin-maleic anhydride copolymer wax; higher fatty acids such as lauric acid, myristic acid, palmitic acid, stearic acid and behenic acid; higher aliphatic alcohols such as stearyl alcohol and docosanol; esters such as higher fatty acid monoglycerides, sucrose fatty acid esters and sorbitan fatty acid esters; and amides and bisamides such as oleic acid amide. These waxes may be used either alone or in combination.

Examples of such thermoplastic resins (inclusive of elastomers) include olefinic copolymers such as ethylene-vinyl acetate copolymer and ethylene-acrylate copolymer, polyamide resins, polyester resins, epoxy resins, polyurethane resins, acrylic resins, vinyl chloride resins, cellulose resins, vinyl alcohol resins, petroleum resins, phenol resins, styrene resins, vinyl acetate resins, natural rubber, styrene-butadiene rubber, isoprene rubber, chloroprene rubber, polyisobutylene and polybutene. These may be used either alone or in combination.

Usable as the coloring agent for the color ink layer are organic and inorganic pigments and dyes of various types, inclusive of carbon black.

The content of the coloring agent in the color ink layer is preferably 5% to 60% by weight.

As required, the color ink layer may further be incorporated with a dispersant, an antistatic agent or other additives.

The coating amount of the color ink layer is usually 0.5 to 3 g/m$^2$. The color ink layer can be formed by hot-melt coating, solvent coating or a like process.

Usable as the foundation for use in the thermal transfer sheet of the present invention are polyester films such as polyethylene terephthalate film, polyethylene naphthalate film and polyarylate film, polycarbonate films, polyamide films, aramid films and other various plastic films commonly used for the foundation films of ink ribbons of this type. Otherwise, thin paper sheets of high density such as condenser paper may be used. A conventionally known stick-preventive layer may be formed on the back side (the side adapted to come into slide contact with a thermal head) of the foundation. Examples of the materials for the stick-preventive layer include various heat-resistant resins such as silicone resin, fluorine-containing resins and nitrocellulose resin, and other resins modified with these heat-resistant resins such as silicone-modified urethane resins and silicone-modified acrylic resins, and mixtures of the foregoing heat-resistant resins and lubricating agents. The thickness of the foundation is typically about 1 μm to about 10 μm.

The present invention will be more fully described by way of Examples and Comparative Examples thereof. It is to be understood that the present invention is not limited to these Examples, and various changes and modifications may be made in the invention without departing from the spirit and scope thereof.

EXAMPLE 1

On one side of a 4.5 μm-thick polyethylene terephthalate film with a stick-preventive layer composed of a silicone resin on the other side thereof was formed a release layer in a coating amount of 0.8 g/m$^2$ by hot-melt coating an ink for release layer of the composition shown below. On the release layer thus formed was formed an intermediate layer in a coating amount of 1.5 g/m$^2$ by applying onto the release layer a coating ink liquid for intermediate layer of the composition shown below and drying. Then, a color ink layer in a coating amount of 1.0 g/m$^2$ was further formed on the intermediate layer by applying thereonto a coating ink liquid for color ink layer of the composition shown below and drying. Thus, a thermal transfer sheet was prepared.

| Ingredients | Parts by weight |
|---|---|
| Ink for release layer | |
| n-Paraffin wax | 80.0 |
| Carnauba wax | 20.0 |
| Coating ink liquid for intermediate layer | |
| Carnauba wax | 2.0 |
| Isoparaffin wax* | 18.0 |
| Toluene | 80.0 |
| Coating ink liquid for color ink layer | |
| Carnauba wax | 4.0 |
| Candelilla wax | 6.0 |
| Ethylene-vinyl acetate copolymer | 6.0 |
| Brilliant Carmine 6B | 4.0 |
| Toluene | 80.0 |

*Content of isoparaffin: 100% by weight

EXAMPLE 2

A thermal transfer sheet was prepared in the same manner as in Example 1 except that the following composition of a coating ink liquid was used to form the intermediate layer.

| Coating ink liquid for intermediate layer | |
|---|---|
| Ingredients | Parts by weight |
| Carnauba wax | 5.0 |
| Ethylene-vinyl acetate copolymer | 7.0 |
| Silica (average particle size: 1 μm) | 8.0 |
| Toluene | 80.0 |

EXAMPLE 3

A thermal transfer sheet was prepared in the same manner as in Example 1 except that the following composition of a coating ink liquid was used to form the intermediate layer.

| Coating ink liquid for intermediate layer | |
|---|---|
| Ingredients | Parts by weight |
| Carnauba wax | 2.0 |
| Isoparaffin wax* | 10.0 |
| Silica (average particle size: 1 μm) | 8.0 |
| Toluene | 80.0 |

*Content of isoparaffin: 100% by weight

COMPARATIVE EXAMPLE

A thermal transfer sheet was prepared in the same manner as in Example 1 except that the color ink layer was formed directly on the release layer without providing the intermediate layer.

Solid printing was performed on a receptor paper sheet (XEROX4024, Bekk smoothness: 40 sec) by subjecting each of the thermal transfer sheet thus prepared to a thermal transfer printer (PHASER200 available from Techtronics Inc.) to form printed images. The gloss of the printed image thus formed was measured four times, (i.e., immediately after the formation of the printed image, one day later, three days later and ten days later) by means of a digital gloss meter (GM-26D available from Kabushiki Kaisha Murakami Shikisai Gijutsu Kenkyusho). The results are shown in Table 1.

TABLE 1

| | Gloss | | | |
|---|---|---|---|---|
| | Immediately after the formation | One day later | Three days later | Ten days later |
| Ex. 1 | 73 | 70 | 68 | 67 |
| Ex. 2 | 74 | 71 | 69 | 67 |
| Ex. 3 | 73 | 71 | 68 | 67 |
| Com. Ex. | 72 | 65 | 59 | 44 |

In addition to the materials and ingredients used in the Examples, other materials and ingredients can be used in the present invention as set forth in the specification to obtain substantially the same results.

As has been described, the thermal transfer sheet comprising an intermediate layer containing an isoparaffin wax and/or a transparent inorganic pigment which is interposed between a release layer containing a paraffin wax having a good transferability and a color ink layer provides printed images of which the gloss is prevented from deteriorating over time.

What we claim is:

1. A thermal transfer sheet comprising a foundation, and at least a release layer containing a paraffin wax, an intermediate layer containing a wax and a heat-meltable color ink layer which are stacked on the foundation in this order, the intermediate layer containing 10% to 100% by weight of an isoparaffin wax.

2. The thermal transfer sheet of claim 1, wherein the release layer contains not less than 70% by weight of the paraffin wax, the paraffin wax containing not less than 50% by weight of n-paraffin.

3. A thermal transfer sheet comprising a foundation, and at least a release layer containing a paraffin wax, an intermediate layer containing a wax and a heat-meltable color ink layer which are stacked on the foundation in this order, the intermediate layer containing 10% to 50% by weight of transparent inorganic particles.

4. The thermal transfer sheet of claim 3, wherein the release layer contains not less than 70% by weight of the paraffin wax, the paraffin wax containing not less than 50% by weight of n-paraffin.

5. A thermal transfer sheet comprising a foundation, and at least a release layer containing a paraffin wax, an intermediate layer containing a wax and a heat-meltable color ink layer which are stacked on the foundation in this order, the intermediate layer containing 10% to 90% by weight of an isoparaffin wax and 10% to 50% by weight of transparent inorganic particles.

6. The thermal transfer sheet of claim 5, wherein the release layer contains not less than 70% by weight of the paraffin wax, the paraffin wax containing not less than 50% by weight of n-paraffin.

* * * * *

UNITED STATES PATENT AND TRADEMARK OFFICE

CERTIFICATE OF CORRECTION

PATENT NO : 5,776,595

DATED : July 7, 1998

INVENTION(S) : THERMAL TRANSFER SHEET

It is certified that error appears in the above-identified patent and that said Letters Patent is hereby corrected as shown below:

Cover page, Item [30], delete "6-170660" and substitute therefor -- 7-170660 --.

Column 3, line 62 delete "pigment" and substitute therefor -- particles --.

Column 4, line 42 delete "pigment" and substitute therefor -- particles --.

Signed and Sealed this

Fourteenth Day of November, 2000

*Attest:*

Q. TODD DICKINSON

*Attesting Officer*

*Director of Patents and Trademarks*